US005589671A

United States Patent [19]

Hackbarth et al.

[11] Patent Number: 5,589,671

[45] Date of Patent: Dec. 31, 1996

[54] ROTARY SWITCH WITH SPRING STABILIZED CONTACT CONTROL ROTOR

[75] Inventors: David G. Hackbarth, New Berlin, Wis.; Kenyon A. Hapke, Libertyville, Ill.; Spencer C. Schantz, Dousman, Wis.

[73] Assignee: US Controls Corp., New Berlin, Wis.

[21] Appl. No.: 518,108

[22] Filed: Aug. 22, 1995

[51] Int. Cl.[6] ..... H01H 19/60; H01H 21/80; G05G 5/06

[52] U.S. Cl. ..... 200/6 R; 200/6 B; 200/6 BB; 200/565; 200/11 R; 74/527

[58] Field of Search ..... 200/6 R, 6 B–6 C, 200/11 R, 11 A–11 TW, 14, 17 R, 291, 293, 303, 307, 565, 568, 569; 74/527, 528

[56] References Cited

U.S. PATENT DOCUMENTS

| | | | |
|---|---|---|---|
| 2,834,842 | 5/1958 | Le Beau | 200/11 K |
| 3,196,237 | 7/1965 | Westgate, Jr. | 200/565 |
| 4,034,178 | 7/1977 | Koppenheffer et al. | 200/293 |
| 4,131,771 | 12/1978 | Erickson et al. | 200/11 G |
| 4,133,990 | 1/1979 | Wanner et al. | 200/6 B |
| 4,182,939 | 1/1980 | Feaster | 200/17 R |
| 4,495,387 | 1/1985 | Thrush | 200/6 B |
| 4,684,905 | 8/1987 | Capek | 74/527 X |

*Primary Examiner*—J. R. Scott

*Attorney, Agent, or Firm*—Ryan, Maki, Mann & Hohenfeldt, S.C.

[57] ABSTRACT

In a rotary switch, a manually rotatable shaft turns a disk which has a plurality of riser cam segments on one of its face. Stepwise rotation of the disk causes the cam segments to press down on flat spring contacts arranged in the switch to put the tip of one of the contacts at a time into electric contact with a stationary electrical contact that is connected to a source of electric potential or, in the alternative, to relieve one of the contacts from being pressed onto the stationary contact. An index wheel mounts to the shaft and has equiangularly spaced grooves. A plastic spring having parallel legs is mounted on the base of the switch. The legs have convex detents which register in successive grooves as the rotor is indexed rotationally in a stepwise fashion. The radius of the detents is greater than the radius of the grooves between the teeth of the index wheel. The legs of the spring are prohibited from moving longitudinally and tension is maintained in the spring legs at all times.

17 Claims, 7 Drawing Sheets

ROTARY SWITCH WITH SPRING STABILIZED CONTACT CONTROL ROTOR

BACKGROUND OF THE INVENTION

The invention disclosed herein pertains to a multiple position rotary switch.

Rotary switches are used in many applications for switching current values of 1mA to 25 amperes. Rotary switches of the indicated ratings are frequently used as control and function selectors in major domestic appliances such as dish and clothes washing machines and clothes dryers. The environment in these machines is usually wet, humid and soapy and is, therefore, hostile to electrical devices such as switches, connectors, and so forth. In the case of a rotary switch in such appliance, it is highly desirable for it to be sealed against entry of moisture or other contaminants which might cause a short circuit and/or corrosion that could disable the switch and the entire machine.

Preexisting rotary switches have weaknesses and difficulties which were not satisfactorily resolved before the new switch disclosed herein was made. One difficulty in preexisting rotary switches is that they often have backlash or freeplay which gives the user a poor feel as if there is elasticity in the parts when the switch is indexed by turning the operating shaft. A corollary to this is that the shaft feels unstable and, often is actually unstable, when the switch is being indexed rotationally from one position to another. Another difficulty has been to properly seal the switch against entry of contaminants along the switch operating shaft and where the lead wires enter and exit the switch. If the lead wires are not properly sealed and anchored, besides allowing entry of contaminants, physical forces on the lead wires externally of the switch housing can distort or dislocate the contacts inside of the housing, thereby causing the switch to operate erratically or fail completely.

SUMMARY OF THE INVENTION

The rotary switch described herein overcomes the above mentioned and other difficulties and problems experienced in preexisting rotary switches.

According to the invention, the new switch design comprises a base composed of nonconductive material such as synthetic resin. A common electric contact strip or bar is mounted fixedly to the base interiorly of the switch housing. A plurality of deflectable or bendable contacts composed of flat spring metal are mounted to the base such that the tips of the contacts are positioned above the stationary common electric contact bar.

The switch includes a basically conventional rotor comprised of a disk having an operating shaft extending axially from it in one direction and a plurality of concentric curved riser cam segments extending in the opposite direction from the disk such that when the rotor is turned the cam segments press on the flexible spring contacts in a predetermined sequence. Pressing a spring contact causes its tip, to touch the metal stationary contact bar and make electrical contact therewith. The rotor disk has a toothed index wheel molded integrally with the shaft and disk. A plastic double-legged spring is mounted to the base and has facing convex offsets, constituting detents, on the long legs of the spring on opposite sides of the index wheel and in contact with the index wheel. The index wheel has equiangularly arranged grooves in its periphery. The grooves are spaces between index teeth. The two convex detents have, according to one feature of the invention, radii that are greater than the radii of the grooves between index wheel teeth so only two tips of two teeth at one time can stay in contact with the spring detents when the rotor turns. Several variations of the spring are presented, all of which assure elimination of hysteresis, the feeling of elasticity, freeplay and backlash from the switch.

Springs are known which have two parallel legs that exert a detent force on an index wheel in a rotary switch so the wheel and rotationally driven cams increment rotationally in discrete switch contact operating steps. Applicants have discovered that it is the parallel legged springs used in conventional ways and strictly according to conventional configurations that is the major contributor to the freeplay, loose and unstable feeling that is unpleasant to one rotating the switch shaft. Applicants have also discovered that maintaining the legs of the spring in tension at all shaft rotational angles overcomes the shaft rotational instability problems. Several modified forms of a two legged spring that experiences tension are disclosed herein.

How the foregoing problems and difficulties mentioned in reference to preexisting rotary switches are solved by the new rotary switch will appear in the more detailed description of the preferred embodiment of the invention which will now be set forth in reference to the drawings.

DESCRIPTION OF A PREFERRED EMBODIMENT

Figures 1, 2:
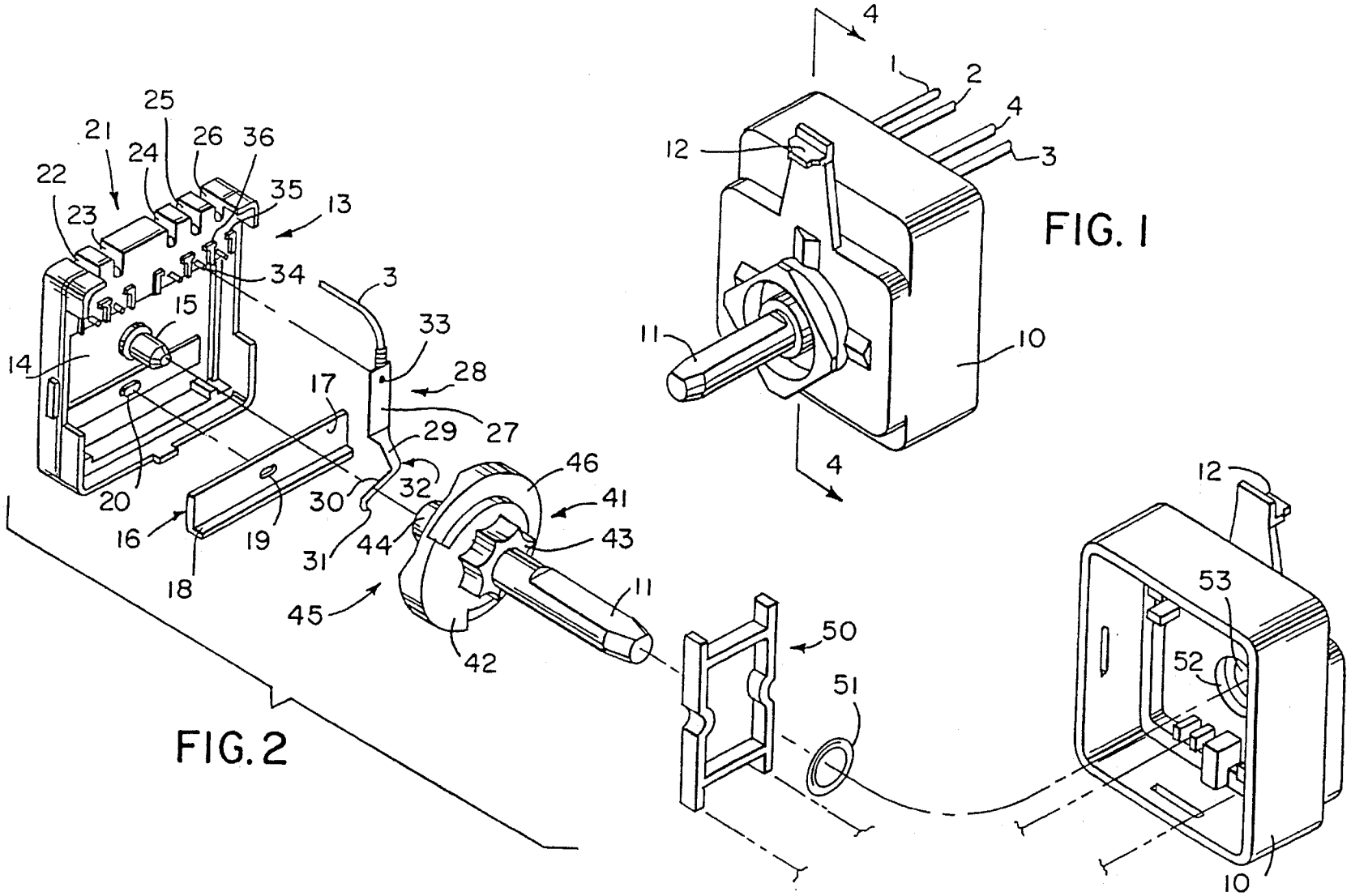
FIG. 1 is a perspective view of the new rotary switch as it appears when it is ready for installation.
FIG. 2 is an exploded perspective view showing the major parts of the rotary switch.

Attention is invited to FIG. 1 which shows the improved operably stable switch fully assembled. The switch comprises a molded plastic housing 10 from which four lead wires marked 1, 2, 3 and 4 extend. The switch is operated by rotating a shaft 11. The depicted model of the switch described herein responds to rotation of shaft 11 by changing the digital logic signal levels of the individual output leads between 0 and 1. The switch has many uses such as in major home appliances, including clothes washers, dryers and dishwashers, for example. Major appliances using state-of-the-art technology usually have a microprocessor based controller, not shown, controlling the functions of the machine that are to be performed at the proper times. The new rotary switch provides digital signal values that the processor interprets and causes a programmed function to be performed.

FIG. 2 is provided for identifying the major parts of the rotary switch. The switch includes a molded base member 13 comprised of plastic insulating material. Base member 13 has a flat back wall 14. A stub shaft 15 projects integrally from the back wall 14. An elongated contact element or bar 16 is shown in position for being inserted and installed stationarily on the back wall 14 of base member 13. Stationary contact element 16 is basically a flat, rectangular bar 17 having a stop edge 18 formed at a right angle to the flat bar 17. The contact element or bar 16 has a hole 19 which fits onto a plastic nib 20 projecting from the back wall 14 of base 13. After contact element 16 is fitted on the nib, the nib is heat swaged or flared to retain the contact element stationarily.

One edge 21 of base 13 in the illustrative embodiment of the switch in FIG. 2 has five notches 22–26. Not all of the notches are used in this version of the switch. In any version, a notch such as notch 26 is for accepting an insulated lead wire 3 which is also shown in FIG. 1. Typical lead wire 3 is electrically connected to a flat portion 27 of a thin spring metal contact 28. The typical deflectable spring contact 28 is preferably composed of phosphor-bronze. Typical spring contact 28 has two essentially flat portions 29 and 30 that are mutually angulated to create an offset which is herein called a knee 32. Contact 28 has a contact tip 31.

Observe in FIG. 2 that typical spring contact 28 has a hole 33. There is a row of molded pins, such as the pin marked 34, shown in FIGS. 2 and 4, projecting from base member 13. The hole 33 and contact 28 slides over typical pin 34. By placing the hole 33 on pin 34, the flat portion 27 of contact 28 becomes captured between ribs 35 and 36 which project from base member 13. When the spring contact 28 is in place, for example, its lead wire 3 is pressed into a notch 26 on the upper rim of base 13. Ultimately, when base member 13 is fitted into housing 10, the back of the base is sealed around its edges with a resin, such as an epoxy resin, so the lead wire 3 becomes bonded in notch 26 and the epoxy seals around the joint between the perimeter 13 of the base and the interior perimeter of the housing as will be explained in more detail later.

In FIG. 2, a rotor 41 is molded unitary with shaft 11, with a rotor disk 42 and with a toothed index wheel 43. A shaft end portion 44 has an axial bore 37, not visible in FIG. 2, but shown in FIG. 3, which constitutes a journal bearing fitting on a fixed stub shaft 15 which projects integrally from base 13. The side of rotor 41 to which the arrowheaded line 45 points has a plurality of concentric spring contact operating riser cams which will be exhibited in other views and will be discussed later.

Rotor 41 has a stop element segment 46 on a side facing the viewer in FIG. 1. The angle subtended by segment 46 determines the angle through which the shaft 11 and, hence, rotor 41 can rotate in either direction between stops which are not visible in FIG. 2. This angle can differ among different versions of the rotary switch used in different applications.

A double-legged detent spring 50 composed of plastic is shown in FIG. 2. Springs of this configuration are known per se but the spring is modified and applied, according to the invention in such a way that is vital to eliminating rotor freeplay and backlash. Expressed in another way, in the new rotary switch the spring is mounted in a manner that eliminates backlash and takes away the poor feel that a user perceives when turning many preexisting rotary switches. The particulars of various embodiments of the spring and its application will be discussed later. It is sufficient to mention at this time that the spring 50 coacts with index wheel 41 in the new assembled rotary switch to give the user who turns the shaft a feeling of constancy with an absence of any freeplay or backlash.

As shown in FIG. 2, an o-ring 51 is sized to fit on shaft 11 next to index wheel 43 to effect a seal between shaft 11 and an annular channel 52 surrounding a hole 53 for the shaft 11 in housing 10. The inside diameter of the o-ring is less than the outside diameter of the shaft so the o-ring is stretched to effect a tight seal between the ring and shaft. The outside diameter, being greater than the inside diameter of channel 52, results in the o-ring experiencing a compressive force when the o-ring is urged into channel 52 so a tight seal is formed between the outside diameter of the o-ring and channel wall.

Figure 3:
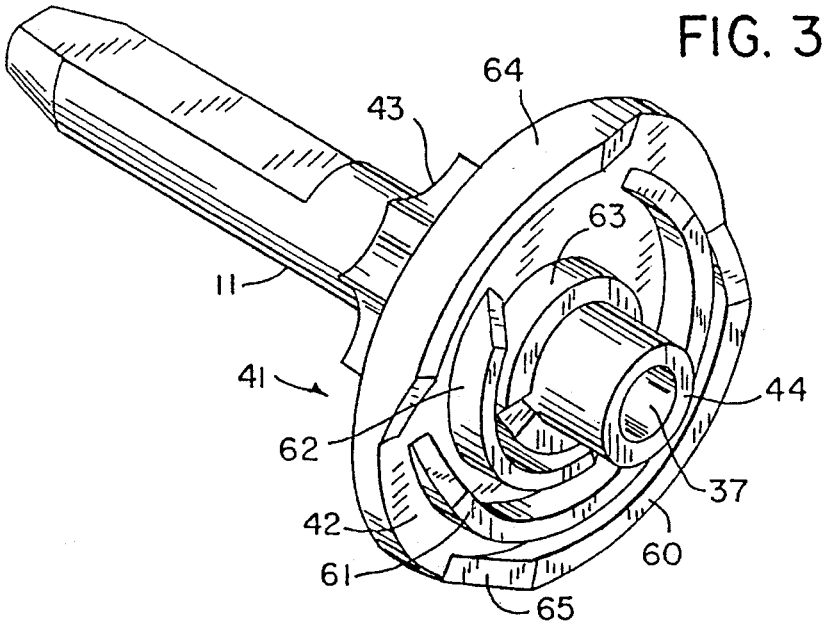
FIG. 3 is a perspective view of one model of several alternative models of a unitary rotor used in the new switch.

A single piece rotor 41 is shown in FIG. 3. All of the so-called versions of the rotor have in common shaft 11, end shaft journal 44 with the journal bore 37 for fitting rotatably on base stub shaft 15, a rotor disk 42 and an index wheel 43. Various versions of the rotor used in different applications of the switch differ in respect to the number of and angular length of the switch contact operating concentric cams 60–64 which the rotor has.

The illustrative rotor 41 in FIG. 3 has formed on its axially remote of disk 42 from shaft 11, a plurality of concentric cam segments 60, 61, 62, 63 and 64. Both ends of each cam segment are tapered as typified by the tapered end marked 65 on cam 60. The tapered ends provide for the cams to ride onto the knees 32 of the spring contacts smoothly to urge the spring contact tips 31 into contact with the stationary common metal contact bar 16.

Figure 5:
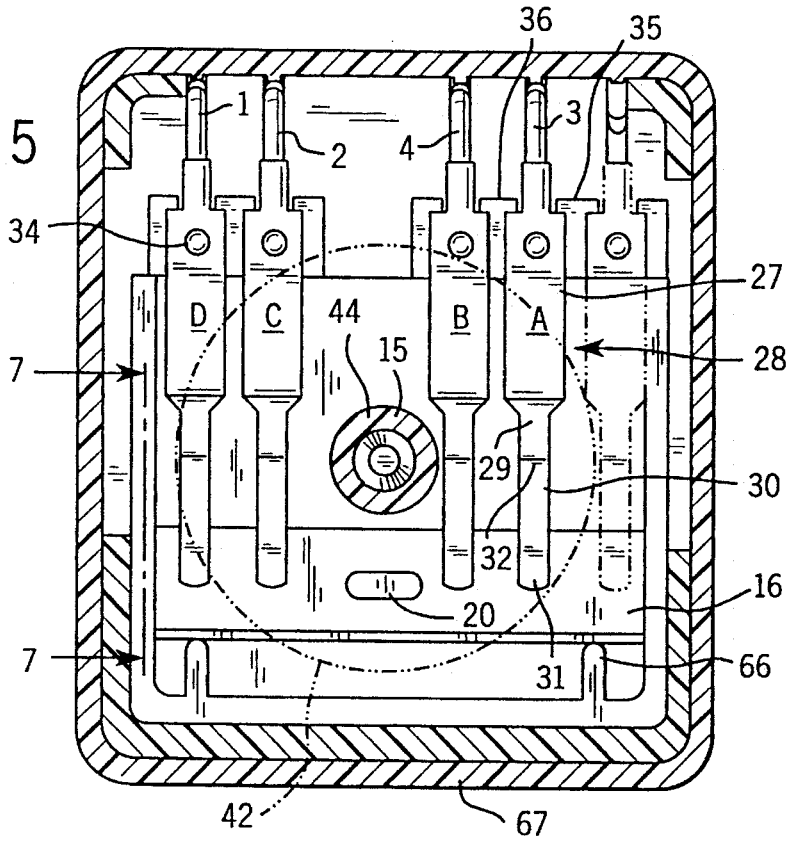
FIG. 5 is a vertical sectional view taken on a line corresponding to 5—5 in FIG. 4.

Attention is now invited to FIGS. 5–10. FIG. 5 shows four spring contacts, generally designated by 28, installed on base member 13 on typical pins 34. A lead wire 3 extends from the typical contact A. A part of the flat area 27 of the spring contact A is stabilized against misalignment and turning on swaged plastic pin 34 by the end portion of the flat area being captured between the previously mentioned T-shaped ribs 35 and 36. The electric current interchange tip 31 of movable spring contact A overhangs the stationary contact bar 16. The rotor disk 42 is omitted but is symbolized by a phantom circle in FIG. 5. Stationary contact bar 16 is electrically a common terminal for being contacted by all movable spring contacts 28. Bar 16 is blocked against shifting by reason of its upstanding margin 18 abutting a pair of stops 66 which project inwardly of a rim 67 of base 13. The swaged plastic anchor pin 20 holds the stationary contact 16 in a fixed position.

Figure 7:
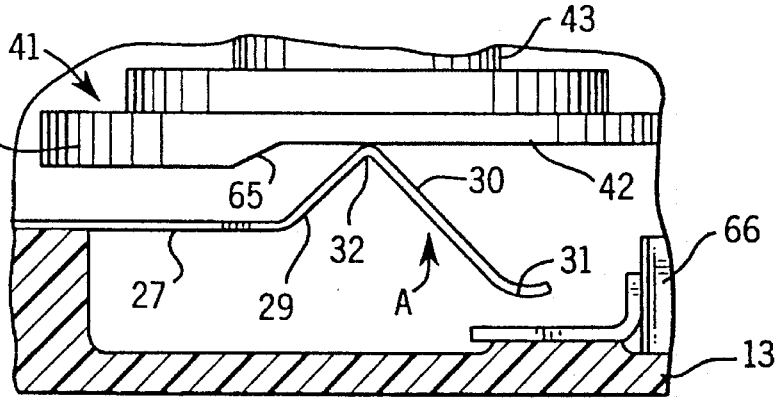
FIG. 7 is a fragmentary sectional view taken on a line corresponding to 7—7 in FIG. 5 showing one of the movable switch contacts in detail and in unoperated position and showing the cam on the depicted rotor in readiness for deflecting the movable switch contact for its tip to make contact with the stationary common contact bar.
Figure 8:
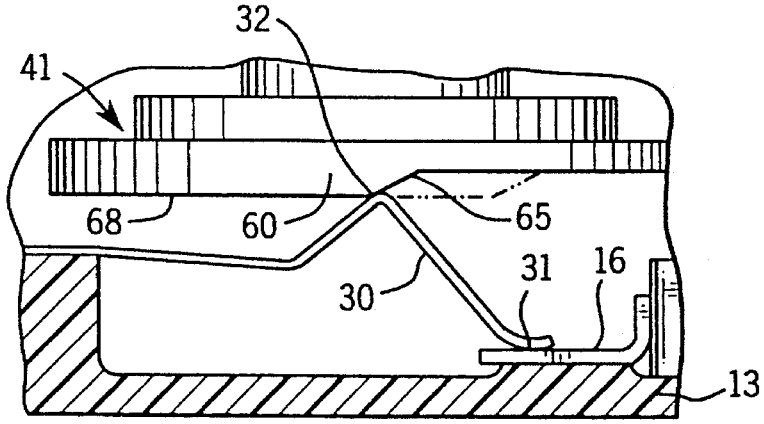
FIG. 8 is similar to FIG. 7 except that the rotor is rotated sufficiently for one of its cams to deflect a movable switch contact.

The profile of a typical contact A is shown supported in cantilever fashion in FIG. 7. Cam 60 on disk 42 of rotor 41 has not been rotated onto knee 32 of the movable or deflectable spring contact as yet in FIG. 8. Hence, the tip 31 of the spring contact is not making electrical contact with the flat portion of stationary contact 16 as yet. In FIG. 8, rotor 41 has rotated or has been indexed sufficiently for the tapered leading end 65 of cam 60 to apply a force on knee 32 which causes contact tip 31 to make physical and electrical contact with stationary bar contact 16. All spring contacts in FIG. 5 are identical structurally to the spring contact which was just discussed. Contact B is a common contact. Its lead 4 is an input lead that is fed from a voltage source, not shown. The tip of power infeed common contact B makes contact with stationary contact 16 as soon as rotor 41 is turned through its first angular step from fully off position, that is, from an angular position where all spring contacts are not touching stationary contact bar 16 and the contact between spring contact B and stationary contact bar 16 is maintained until the switch is operated back to off position wherein none of the spring contact tips 31 are in electrical contact with stationary contact 16.

Figure 6:
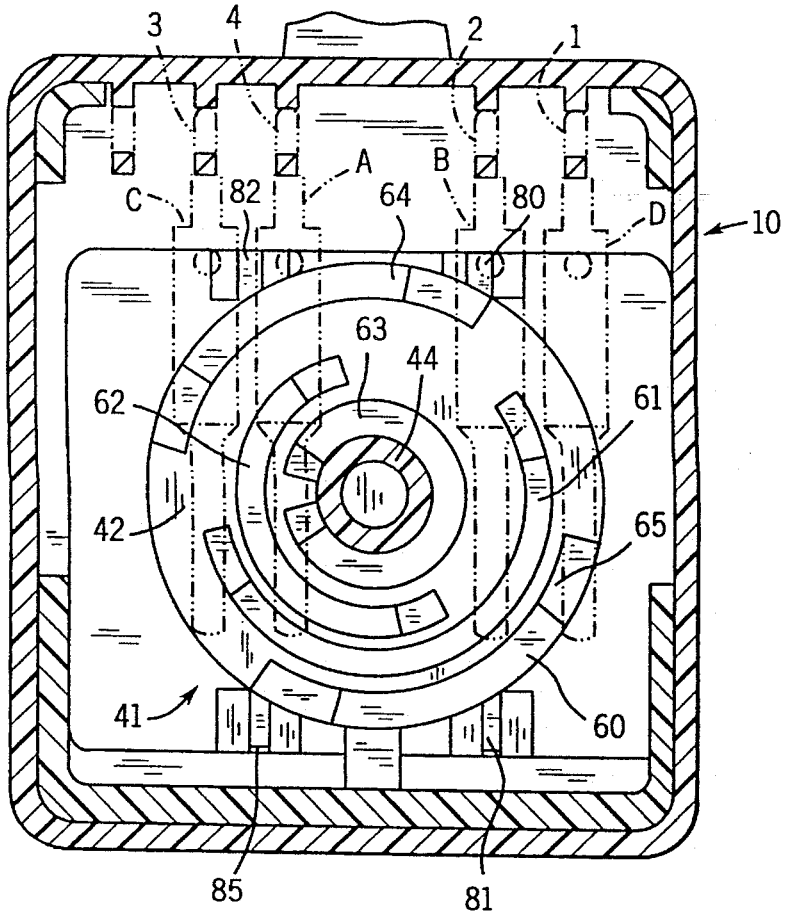
FIG. 6 is a vertical sectional view taken along a line corresponding to 6—6 in FIG. 4.

If the housing 10 with the cams of the rotor 41 facing toward the observer in FIG. 6 is flipped over and superimposed on the base 13 in FIG. 5, the cams on the rotor become properly related to their cooperating contacts which the cams operate. Thus, voltage infeed contact B in FIG. 5 is in the circular rotational path of radially innermost cam 63 in FIG. 6. The first angular step of the rotor from off position results in connecting infeed common spring contact B to stationary contact 16 so that contact 16 is electrified at a voltage corresponding to customary digital logic voltage of about five volts, for example. As is evident in FIG. 6, the spring contacts are arranged in phantom mirror image to what they are in FIG. 5, so as soon as the leading end of cam 63 is turned to an angle of 45 degrees in the direction of arrow 73, spring contact B makes contact with common stationary contact 16. In this particular version of the switch, cam 63 intercepts a central angle total 270° and would return to the angular position in which it is shown in FIG. 6 after the rotor 41 has been rotated to 270°.

The next radially outwardly displaced cam 62 in FIG. 6 acts on spring contact B when the rotor and, hence, cam 62 is rotated three angular increments of 45° each. Cam 62 subtends an angle of 135°.

The next radially outwardly displaced cam 61 in FIG. 6 begins to act on spring contact C when the rotor and cam 61 rotate 45° from switch off position or 000. Cam 61 subtends and angle of 135°.

Radially outermost cams 60 and 64 operate spring contact B. When rotor 41 has turned two angular increments from switch off position, cam 64 operates spring contact D. After the next 45° increment of rotation, rotor 41 rotation, spring contact D opens because cam 64 subtends an angle of 45° which is one angular step. After the rotor rotates 270° , the cam 60 operates the spring contact to a conductive state again.

The number of cams and their arrangement in the illustrative rotary switch discussed herein are intended to be demonstrative of the capabilities of the switch. There are versions or models where more or fewer cams and spring contacts are used in which case, fewer or more bits, respectively, for representing a binary number are needed. In the illustrative embodiment, three bit digital numbers are sent to a microprocessor based controller, not shown, which means that, excluding zero position of the rotor, seven unique digital signals or logic states can be produced, and the processor could dictate execution of eight functions by a machine where all zero bit digital numbers are included.

Figure 11:
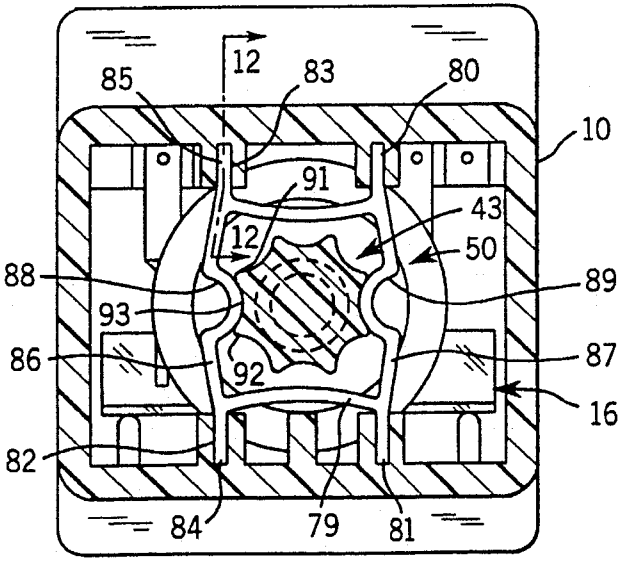
FIG. 11 is a vertical sectional view taken on a line corresponding to 11—11 in FIG. 4 with some parts omitted and showing one form of the double-legged spring.

A significant feature of the new rotor is that it gives a good feel to the user when shaft 10 is rotated because the rotor is stabilized at all times. The good feel and stable state is a consequence of the absence of backlash and freeplay in the switch design. This is achieved by the way a generally known double-legged spring 50 and cooperating index wheel 43 are refined structurally, in accordance with the invention, and in respect to the way they cooperate. One form of spring 50 is shown installed in switch housing 10 in FIG. 13. The housing, as shown in FIG. 11, has four interior slots 80, 81, 82 and 83. Typical leg tip portions 84 and 85 are shown registered in slots 82 and 83. Typical side legs 86 and 87 of spring 50 have centrally positioned curved convex detents 88 and 89, respectively. Legs 86 and 87 may be but are not necessarily tied together by lateral struts 79. In FIG.

11 it is evident that, in a sense, the index wheel 43 is sufficiently large diametrically, compared to the distance between detents 88 and 89 so that legs 86 and 87 of the spring become deflected when the spring is pressed onto the index wheel 43. In other words, the spring 50 is prestressed even when the rotor shaft and, hence, the index wheel 43 are not rotating. In accordance with the invention, however, the convex radii of curvature of the detents 88 and 89 on the spring side legs are greater than the radius of curvature of the arc 90 between the tips 91 and 92 of any consecutive index wheel teeth so a gap 93 exists between the convex typical detent 89 and the concave surface existing between two consecutive tips such as 91 and 92, of the index wheel 43. The gap 93 and the way the tooth tips 91 and 92 of the index wheel 43 bear on a detent 88 are more easily visualized in the FIG. 10 magnified view. The tips 91 and 92 make line contact on the typical spring detent 88 as a consequence of the difference in radii between the typical detent 88 and index wheel tips 91 and 92 though no freeplay is present nor could any be felt, when a knob, not shown on shaft 11 is grasped manually to start rotation of rotor disk 42.

Figure 13:
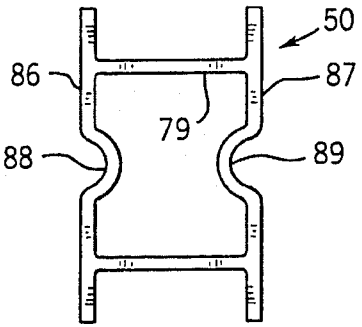
FIG. 13 is a front elevational view of a double-legged spring of conventional type but is used in accordance with the invention.

FIG. 13 shows one type of double-legged spring that fulfills the antibacklash and zero freeplay objectives achieved with the spring and index wheel in accordance with the invention. The spring in this FIGURE appears on first impression to be comparable to a conventional spring of this type but it is not when used in the way it is used in FIG. 12. A conventional spring would have side legs 86 and 87 of such length that the spring would drop freely into the slots 80–83 in the FIG. 11 base and the legs would be parallel. Then when the index wheel 43 is inserted, according to prior practice, the legs would bulge outward away from each other and the tips of the legs would, respectively, pull away from the bottoms of the slots 80–83. Thus, there would be a gap between each leg to tip and the slot bottom. The consequence of this prior practice is that when the index wheel starts to turn the legs are stressed in opposite directions. The spring distorts, gaps at diagonally opposite ends of the legs get larger depending on the direction of rotation, and the person turning the shaft 11 gets the unpleasant feeling of freeplay and looseness.

Figure 14:
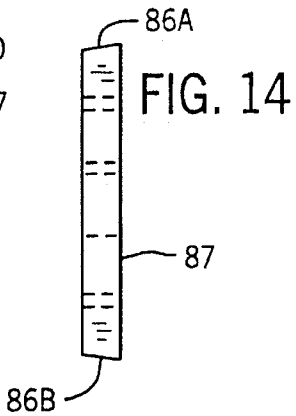
FIG. 14 is a side elevational view of the spring depicted in FIG. 13.
Figure 12:
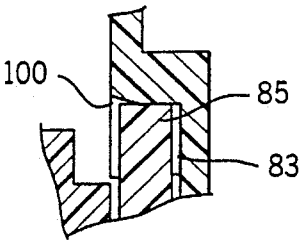
FIG. 12 is a fragmentary vertical sectional view taken on a line corresponding with 12—12 in FIG. 11.
Figure 10:
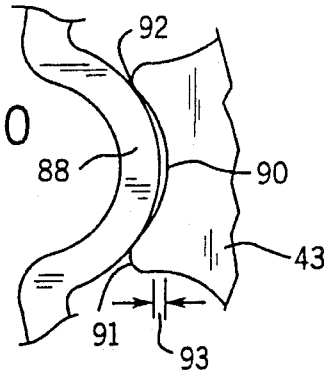
FIG. 10 is a magnified view of a part of FIG. 7 showing how the contours of the double-legged spring detent and the index wheel mate when the index wheel is in a quiescent angular position.

Applicants have discovered that the feeling of variable resistance and freeplay incidental to turning the shaft can be eliminated if the spring is stabilized at all times. Stabilization has been achieved in FIG. 11 by making the legs, such as typical leg 87 of the spring, longer than the distance between the bottoms of the slots 80 and 81 so the spring must be forced into the slots 80–83. To facilitate accomplishing the forced fit and preloading of the spring legs, the ends 86A and 86B of typical spring leg 86 are beveled as shown in FIG. 14. Alternatively, if one wants to limit the bevel angle to no more than is required for the draft a plastic spring needs to withdraw it from a mold one may resort to what is done in FIG. 12 to facilitate forcing the spring into the slots. In FIG. 12 the slot 83, which is isolated from FIG. 11, has a beveled edge 100 so the square end of the spring leg tip 85 can be forced into slot 83.

Figure 15:
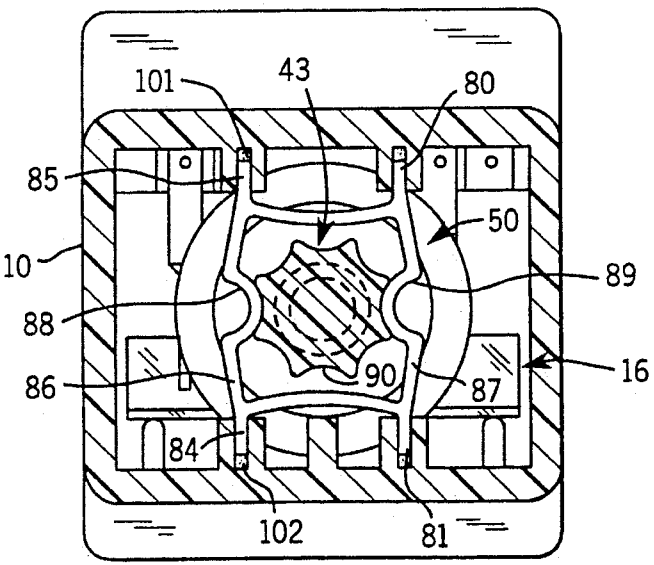
FIG. 15 is a vertical sectional view taken on a line corresponding to 11—11 in FIG. 4 but a different double-legged spring is substituted for the spring shown in FIG. 11 although all other parts of the FIG. 15 switch are the same as in the FIG. 11 switch.

FIG. 15 illustrates restraining the tips of the spring legs in the slots in a manner that differs from the manner in which end-play of the spring legs is prevented in FIG. 11. In FIG. 15 typical tips 84 and 85 of typical spring leg 86 are anchored in the slots either by ultrasonic staking or with a bonding agent such as epoxy resin at places 101 and 102. The spring is installed in base and then the index wheel 43 is pressed into the spring. If the sots are substantially larger than the size of the legs when ultrasound bonding is intended to be used, then it is desirable to insert a small fragment or powder composed of a compatible plastic to tighten the fit between the end of the spring legs and the slot before applying the ultrasound.

Figure 16:
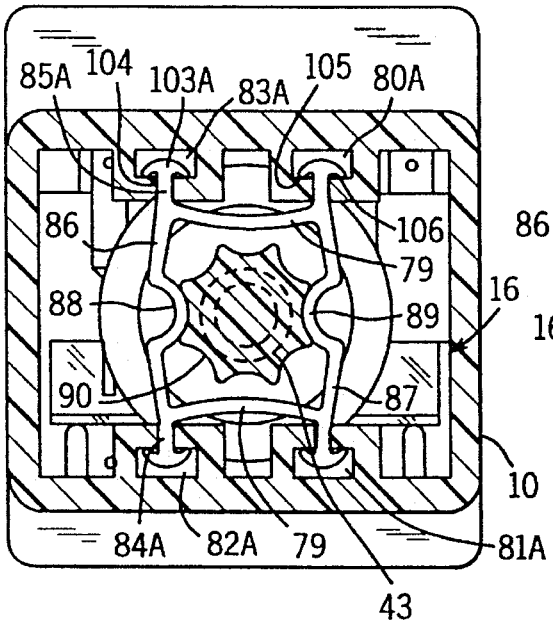
FIG. 16 is a vertical sectional view taken on a line corresponding with 11—11 in FIG. 4 but a different style of the double-legged spring is substituted for the spring in FIG. 11 although other parts of the FIG. 16 switch are the same as the FIG. 11 switch.

In FIG. 16 the spring 50 is stabilized by imparting tension to legs 86 and 87. In this embodiment the end portions, such as end portions 84A and 85A of spring leg 86, are provided with nominally T-shaped tips or extremities 103A. Slots 80A–83A are generally T-shaped. The end portions of the spring legs fit snugly through the slot openings 104. In this case, the T-shaped tips 103 have a crescent shaped cross sectional configuration such that two lines of contact 105 and 106 are made by the tips 103 on the wall of a slot as shown. Tension is maintained in legs 86 and 87 and pressure at the lines of contact 105 and 106 are enhanced by the forces developed when the legs are flexed apart by their detents 88 and 89 passing over the index wheel 43 during assembly of the spring to base 10. Although it is not apparent in FIG. 16 there is, in fact, an increase in the radii of the detents 88 and 89 of the spring when the spring is fitted on the index wheel 43 so the detents do not bottom out in the grooves 90 of the index wheel as will be discussed in more detail later. In the FIG. 16 embodiment, when the index wheel 43 is turned, the high points or teeth on the wheel must run along and finally toggle over the detents 88 and 89. However, since the legs 88 and 89 of spring 50 are flexed outwardly and prestressed even when the index wheel is at rest as depicted, the detents continuously apply a force on the index wheel as the wheel turns, thereby giving the person turning the shaft a solid feeling for all degrees of wheel rotation. As in all embodiments, in the FIG. 16 embodiment, during assembly of the switch, the spring is installed in the slots first and then the index wheel 43 is pushed into the spring.

Figure 17:
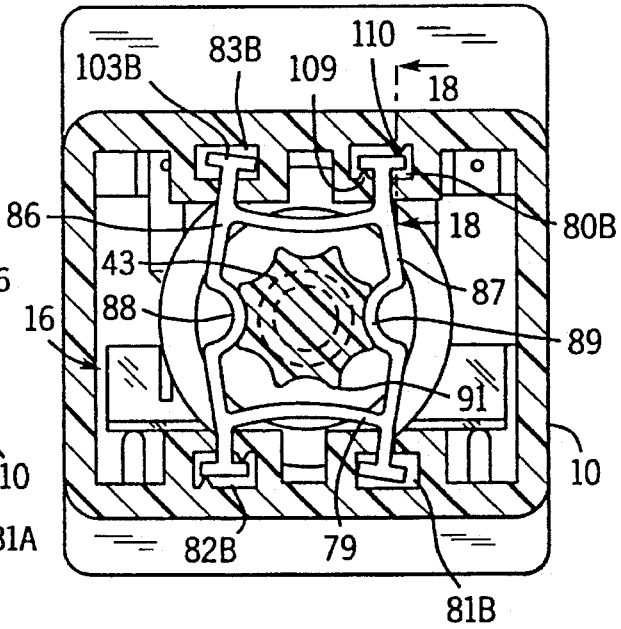
FIG. 17 is a vertical sectional view taken on a line corresponding to 11—11 in FIG. 4 but the double-legged spring differs from the spring in FIG. 11 by reason of the FIG. 17 spring having diagonally opposite ends of the legs T-shaped and restrained in slots that have elements for preventing the spring legs from moving longitudinally when the spring legs are stressed longitudinally by the rotating index wheel.

In the FIG. 17 embodiment the ends 103B of the spring 50 legs or sides 86 and 87 are T-shaped but the heads 103B of the T's are shaped slightly differently from the crescent shaped heads 103A in FIG. 16. In FIG. 17, the T-shaped ends 103B of the spring legs are disposed in slots 80B–83B as are their counterparts in FIG. 16. The ends 103B of the spring legs in FIG. 17 are designated to develop a torsional moment of force on diagonally opposite ends of the spring to limit lateral motion of the spring. In this case, diagonally opposite slots 80B and 82B each have a pair of force concentrators 109 and 110 in them. The apexes of the triangularly shaped force concentrator engage the cross heads of the T's almost at the extremities of the heads. The head ends of the T's in diagonal slots 81B and 83B do not require the cross heads but are provided to make the spring symmetrical so no attention need be given to which way the spring goes into the base slots 80B-83B. In this embodiment, it is when the legs of the spring are flexed outwardly by assembly with index wheel 43 that the torque is applied to the T-head which torque is resisted by the force concentrators 109 and 110. The arrangement prohibits longitudinal motion of spring 50 for either direction of index wheel rotation. The presence of a T-head only on diagonally opposite spring ends is sufficient to prevent occurrence of any feeling of free play when the index wheel 43 is turned.

Figure 18:
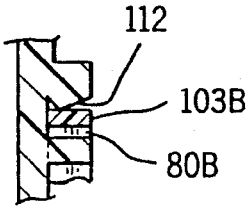
FIG. 18 is a fragmentary section taken on a line corresponding with 18—18 in FIG. 17.

FIG. 18 shows that the slots, such as 80B, have a bevel 112 to make insertion of the spring into the slots easier during switch assembly.

Figure 21:
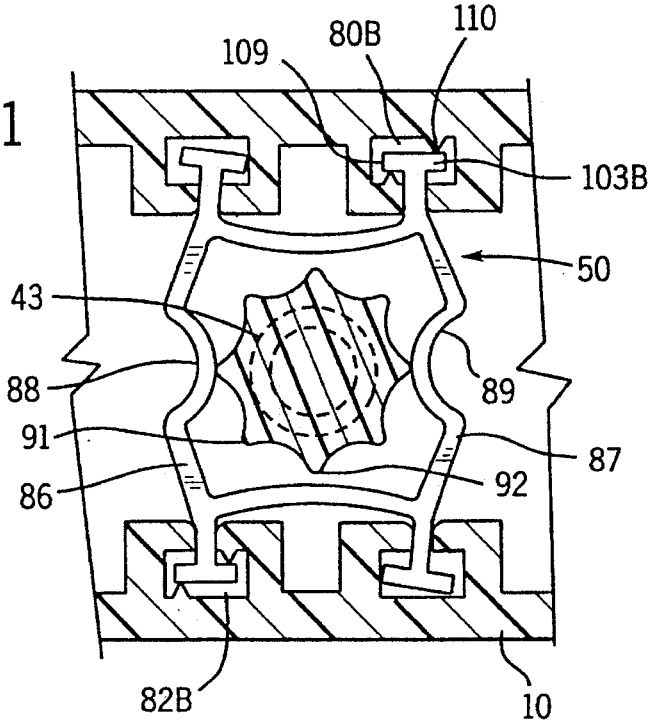
FIG. 21 is similar to FIG. 17 except that in FIG. 21 the toothed index wheel is rotated to where the tips of diametrically opposite teeth on the index wheel are passing the midpoints of the convex detent formations on legs of the spring.

FIG. 21 shows the desirable result of restricting the ends of the spring legs during passing of the peaks 91 of the teeth on the index wheel 43. The stabilizing force on the index wheel is the result of outward flexing of the spring legs 86 and 87. Regardless of the direction in which index wheel 43 turns in this case, the legs 86 and 87 will never go into tension because, although opposite diagonal spring ends in the slots 80B and 82B containing force concentrator 109 are fixed, the opposite spring ends in slots 81B and 83B are free.

Figure 19:
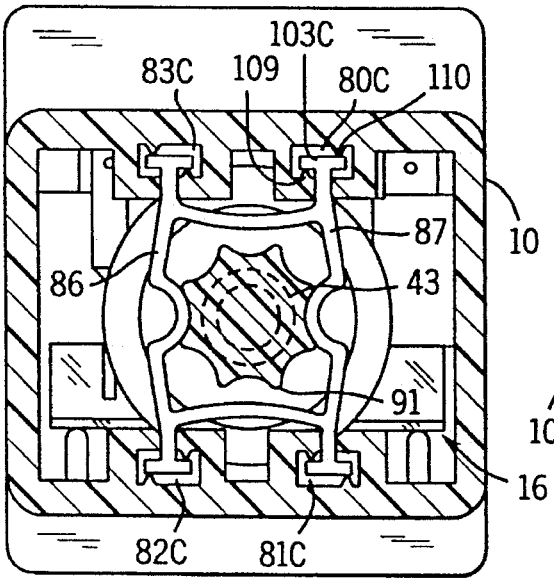
FIG. 19 is a vertical sectional view comparable to FIG. 17 except that the spring in FIG. 19 has both ends of both legs terminated in T-shaped ends which are restrained in slots that differ in configuration from the slots in FIG. 4.

In the FIG. 19 embodiment of the switch, all of the end portions of spring sides or legs 86 and 87 are T-shaped as indicated by numeral 103C. All of the slots 80C–83C are provided with force concentrators 109 and 110.

Figure 20:
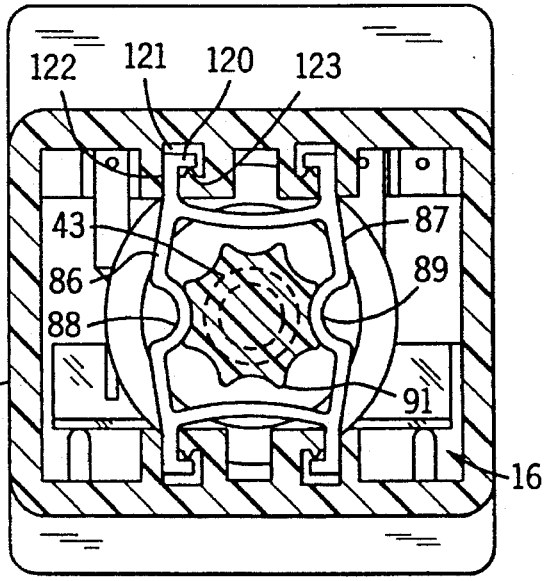
FIG. 20 is a vertical sectional view taken on a line corresponding with 11—11 in FIG. 4 but the double-legged spring differs from the spring in FIG. 11 by reason of each of the legs of the spring in FIG. 20 terminating in L-shaped ends.

In the FIG. 20 embodiment stability of the index wheel 43 throughout every rotational step is achieved by forming all end portions of spring legs 86 and 87 in the shape of the letter L. The end portions could also be characterized as being hook-shaped. A typical end portion of a spring leg has a part 120 which is at a right angle relative to typical leg 86. The legs or sides 86 and 87 of the spring are parallel before the index wheel 43 is inserted. When the index wheel is inserted the legs flex apart as shown in FIG. 20 as well as in other FIGS. Ends 120 reside in slots such as the slot marked 121. The end portion of a spring passes through the throat 122 of the slot with small clearance. The end 120 bears near its extremity on the apex 123 of a triangular force concentrator. Hence, when the index wheel 43 is installed, detent 88, deflects the legs 86 and 87 outwardly. The tension force acts through a moment arm constituted by the short distance between straight leg portion 122 of the spring and the apex 123 of the force concentrator. When end 120 deflects by a small amount due to the tension force in the spring, the end 120 stores a force which tends to restore it to its undeflected state. Thus, when the tip 91 of the index wheel 43 passes beyond the center of a detent 88 or 89 during an indexing step the tension in the spring leg begins to decline. However, the stored force in the spring end 120 moment arm tends to keep the leg tension constant until the detents are fully registered in the recesses that are bounded by the teeth of the index wheel. As a result, the person turning the shaft of the rotary switch experiences a steady solid feeling throughout each indexing step with the complete absence of freeplay at the beginning and end of the step.

Figure 22:
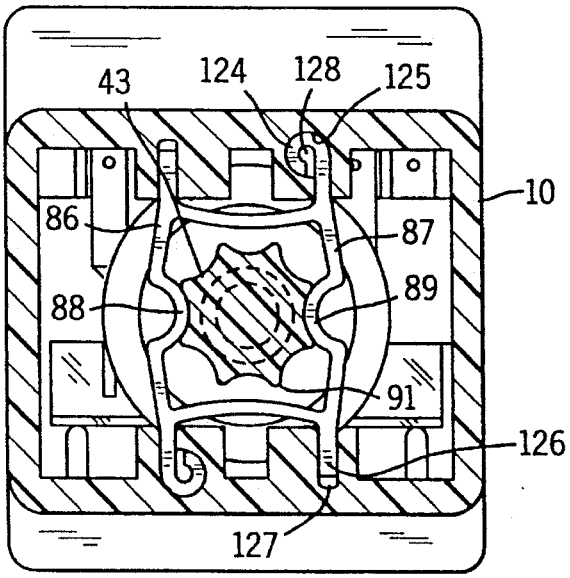
FIG. 22 is a vertical sectional view taken on a line with 11—11 in FIG. 4 but the configuration of the ends of the spring legs and the configuration of the slots which contain the spring ends differ from other of the embodiments.

An alternative method of controlling end-play of spring legs 86 and 87 is shown in FIG. 22 where one end of each spring leg 86 and 87 contains a circular compressible loop 124 with a radius about center 128 and fitting in circular recess 125 in base 10.

The other end of the spring leg 126 fits in a conventional manner in slot 127. It is to be understood that loop 124 may be oversize of recess 125 so that there is a slight compression in inserting the part during assembly thereby eliminating any free play at the beginning and end of the detent. This detail is repeated on spring leg 87.

Figure 23:
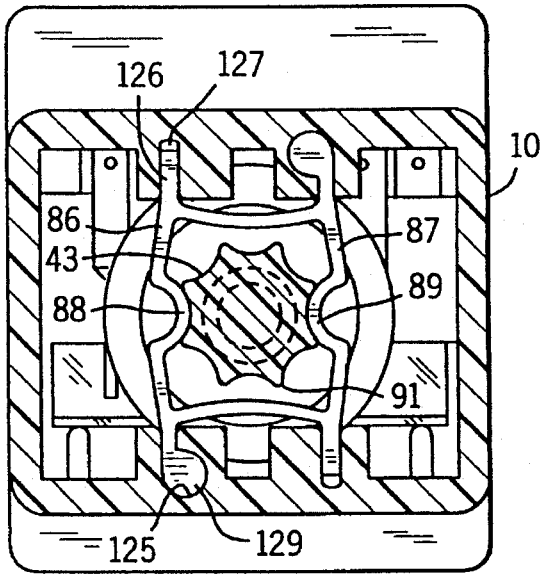
FIG. 23 is a vertical sectional view taken on a line corresponding with 11—11 in FIG. 4 but the configuration of the ends of the spring legs and the configuration of the slots which contain the spring ends differ from most of the embodiments except FIG. 22.

Referring to FIG. 23, spring legs 86 and 87 have at one of their ends a head 129 which fits snugly into recess 125 with the alternate end 126 being retained in a conventional fashion in slot 127. This is repeated on spring leg 87 and provides longitudinal restraint of the spring legs in spite of variations in molding tolerances and shrinkage to minimize free play at the beginning and the end of each detent step. The head 129 may be tapered to facilitate tight assembly into recess 125. Conversely, recess 125 may be tapered.

The fragmentary magnified view of the typical cooperating detent 88 of the spring and index wheel tooth tips 91 and 92 shows the gap 93 that results from the radii differences. According to prior practice, the contour of the detent is exactly complementary to the curve between typical index wheel tooth tips 91 and 92 and the convex contour of the detent. This results in an unstable feel on the shaft.

Figure 9:
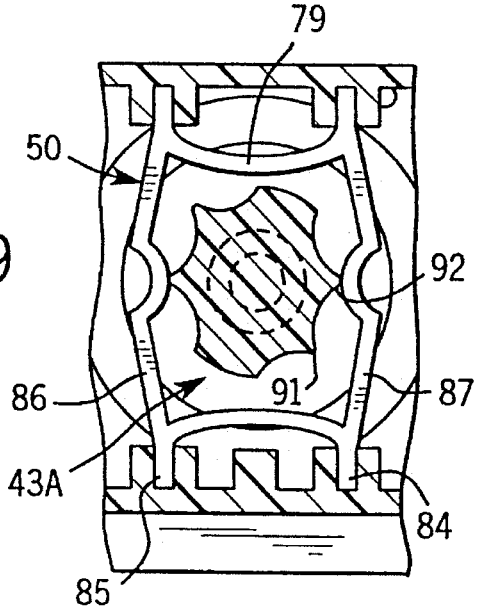
FIG. 9 is a fragmentary sectional view showing how a spring, complying with the general nature of the spring embodiments disclosed herein, deforms as the index wheel of the rotor is halfway between two angularly adjacent index positions.

FIG. 9 shows an index wheel 43A of slightly modified form as compared with wheel 43 in FIG. 2. The wheel is half way through the process of indexing one angular step. When the index wheel 43A is at top dead center as it is in FIG. 9, deflection of the spring legs 86 and 87 is substantial. Because the spring was prestressed by virtue of its tight fit on the index wheel at any time that the wheel is turned to a position where a cam on the disk is positively operating one of the spring contacts, the legs of the spring contact are stressed and deflected as exhibited in FIG. 11.

Figure 4:
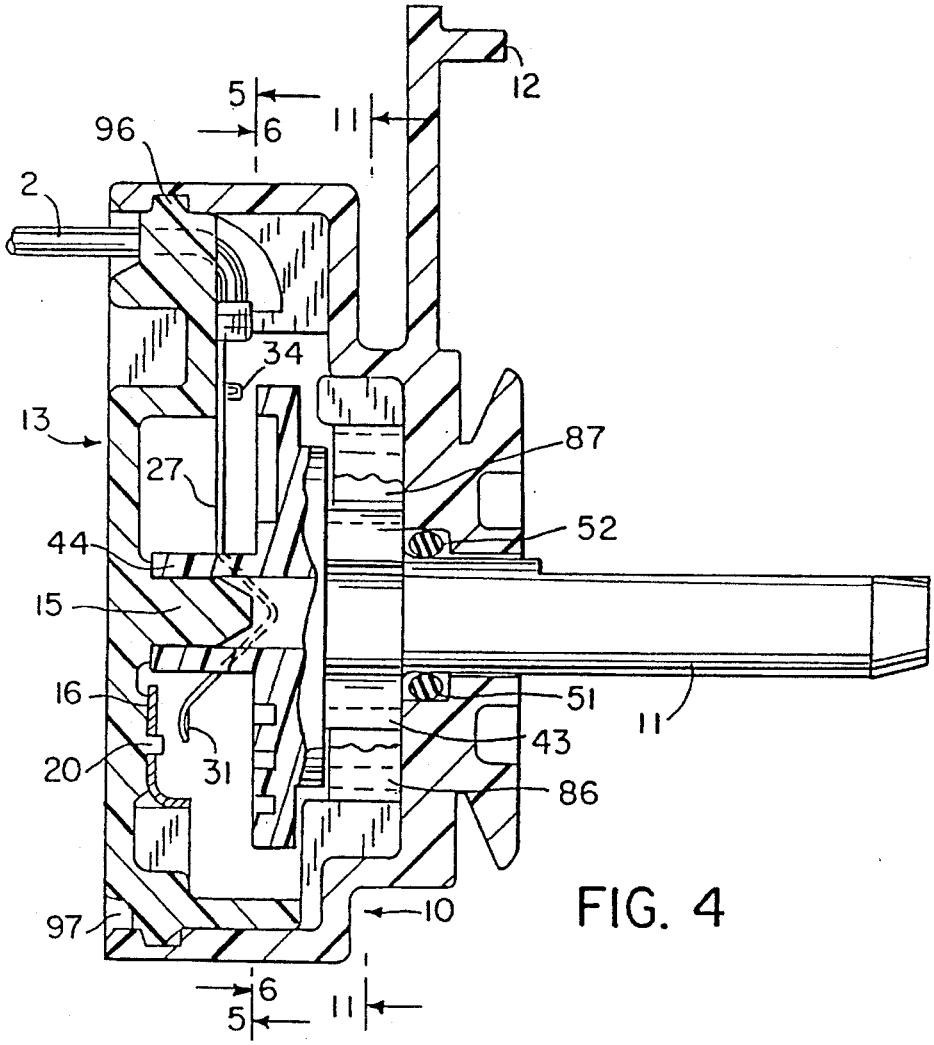
FIG. 4 is a sectional view taken on a line corresponding to 4—4 in FIG. 1.

FIG. 4 illustrates the o-ring 51 in section on shaft 11. Observe that the o-ring is elongated axially of the annular cavity 52 in the housing and is also pressing snugly against the wall of cavity 52 and the shaft 11 to produce a very effective seal against water migrating into the switch housing along the shaft. The base member 13 is provided with four tabs 96 that snap into complementarily-shaped grooves in the housing 10 to retain the base member 13 in the housing.

The perimeter of the base member is configured such that in relation to the rim of the housing 10, a moat 97 is formed about the perimeter. Moat 97 is filled with a sealant such as epoxy resin to form a water tight seal.

Refer now to FIG. 6, which shows the cams 60–64 on disk 42 of illustrative rotor 41 in their entireties. That is, the cams are shown realistically as having tapered leading and trailing ends such as the typical end 65.

Although a preferred embodiment of the invention has been described in detail, such description is intended to be illustrative, rather than limiting, for the invention may be variously embodied and is to be limited only by interpretation of the claims which follow.

We claim:

1. A rotary switch comprising:

a base member and a housing for enclosing the base member, a plurality of electrical switch contacts mounted to said base member, a rotor including a shaft journaled for rotation in said housing and means on said shaft for operating said switch contacts in response to rotation of said shaft, and including an index wheel mounted to the shaft coaxially therewith, said index wheel having circumferentially spaced apart radially outwardly extending teeth defined by curved radially inwardly depressed recesses between said teeth, a plastic spring operatively engaged with said index wheel to control said rotor to turn in discrete angular steps when said shaft is turned, said spring is comprised of two longitudinally extending laterally spaced apart deflectable legs having opposite free end portions and struts spanning laterally between said legs and joined with said legs, respectively, near said opposite free end portions, each of said legs having a detent formed therein intermediate of said free end portions, said detents being convex and registered in said recesses of said index wheel when said rotor has turned one step, said housing having pairs of laterally spaced apart slots with said pairs of slots longitudinally spaced apart to provide for inserting in said pairs of slots said free end portions of said legs of said spring and, said end portions of said legs being constrained in said slots to prevent said legs from moving longitudinally by any amount when said legs are deflected by said detents thereon passing over said tips of said index wheel teeth when said rotor is turned.

2. A rotary switch according to claim 1 wherein said legs of the spring are constrained against longitudinal movement during movement of said rotor through an angular step by having the legs be longer than the longitudinal distance between slots such that said legs must be deflected and prestressed to insert said end portions in said slots.

3. A rotary switch according to claim 2 wherein said slots have beveled edges for leading said end portions of said legs into said slots.

4. A rotary switch according to claim 2 wherein said end portions of said legs are beveled for leading said end portions of said legs into said slots.

5. A rotary switch according to claim 1 wherein said deflectable legs of said spring are constrained against longitudinal movement during movement of said rotor through an angular step by adhesive bonding said end portions of the legs in said slots.

6. A rotary switch according to any one of claim 1, wherein said deflectable legs of said spring are constrained against longitudinal movement during movement of said rotor through an angular step by ultrasonic deformation of material between said end portions of said legs and said slots.

7. A rotary switch according to claim 1 wherein an ultrasonically melted and solidified filler material fills in free space that would otherwise exist between said end portions of said spring legs and said slots, respectively.

8. A rotary switch according to claim 1 wherein:

said slots each have a T-shaped cross sectional configuration composed of a laterally extending opening having sidewalls and a passageway leading to said opening through which said leg end portions of said spring pass, and a shoulder is defined on each side of said passageway where it passes through said sidewall, said end portions of said legs, respectively, terminating in heads having laterally opposite shoulders bearing, respectively, on the side of said passageway for maintaining tension in said legs to prevent longitudinal motion of said legs.

9. A rotary switch according to claim 1 wherein:

said slots respectively, have a T-shaped cross sectional configuration including a laterally extending opening defined by opposite longitudinally spaced apart front and rear walls and a passageway leading to said opening through said front wall and through which passageways said leg end portions, respectively, of said spring pass, and a shoulder is defined on said front wall on each side of where said passageway enters said opening, at least the opening into which the leg end portion of one leg of the spring passes and the opening into which the opposite leg end portion of the other leg of said spring passes having extending from their said rear walls into said opening a first fulcrum apex and having extending from their rear walls in a direction opposite of said first apex fulcrum a second apex fulcrum said apex fulcrums being positioned symmetrically to said passageways, respectively, of said end portions of the spring legs, said end portions of said legs of said spring terminating in a T-shaped configuration including a laterally extending cross element engaged on one side with the fulcrum apex extending from said rear wall of said opening and engaged on the opposite side with said fulcrum apex extending from said front wall of said opening.

10. A rotary switch according to claim 1 wherein opposite end portions of opposite legs of the spring terminate in T-shaped heads and said slots in which said heads register are T-shaped to prohibit longitudinal motion of said legs when said rotor is turned, said slots, respectively, containing diagonally opposite projections on which said heads bear, said projections effecting a torsional force on said heads to preclude end play of said legs when the rotor is turned.

11. A rotary switch according to claim 10 wherein all of said end portions of said legs terminate in head portions, respectively, and heads on opposite ends of opposite legs are free to move longitudinally.

12. A rotary switch according to claim 11 wherein:

all of said openings in said slots are provided with said fulcrum apexes cooperating with said cross elements of said end portions of said spring legs.

13. A rotary switch according to claim 1 wherein:

said slots respectively, include an opening defined by longitudinally spaced apart rear and front walls and a passageway through which a leg end portion of said spring extends, said passageway intersecting said opening adjacent a shoulder region on said front wall and a fulcrum apex extends into said opening from said shoulder region laterally displaced from said passageway, said end portions of said spring legs, respectively, terminating in an L-shaped configuration having a laterally extending segment constituting an arm having an extremity bearing on said fulcrum apex.

14. A rotary switch according to claim 1 wherein the radius of curvature of said detents on said spring legs is greater than the radius of curvature of said recesses between said teeth of the index wheel.

15. A rotary switch according to claim 1 wherein opposite end portions of opposite legs of said spring terminate in enlarged heads having a particular configuration and said slots in which said heads register have a corresponding configuration.

16. A rotary switch according to claim 15 wherein said heads are tapered for facilitating insertion in said slots and fitting tightly therein for preventing longitudinal end play of said legs.

17. A rotary switch according to claim 15 wherein said enlarged heads are configured, respectively, as a spring loop which is resilient and fits resiliently into a correspondingly configured slot.

* * * * *

UNITED STATES PATENT AND TRADEMARK OFFICE

CERTIFICATE OF CORRECTION

PATENT NO. : 5,589,671

DATED : December 31, 1996

INVENTOR(S) : David G. Hackbarth; Kenyon A. Hapke; Spencer C. Schantz

It is certified that error appears in the above-identified patent and that said Letters Patent is hereby corrected as shown below:

Column 11, Line 18 Delete "any one of"

Signed and Sealed this

Third Day of March, 1998

Bruce Lehman

*Attest:*

BRUCE LEHMAN

*Attesting Officer*

*Commissioner of Patents and Trademarks*